US005239280A

United States Patent [19]

Noguchi et al.

[11] Patent Number: 5,239,280

[45] Date of Patent: Aug. 24, 1993

[54] DIELECTRIC FILTER HAVING INDUCTIVE INPUT/OUTPUT COUPLING

[75] Inventors: Toshiharu Noguchi; Kazuhiro Eguchi; Takumi Naruse; Kouichi Watanabe; Kuniaki Kiyosue; Hiromitsu Taki, all of Miyazaki, Japan

[73] Assignee: Matsushita Electric Industrial Co., Ltd., Osaka, Japan

[21] Appl. No.: 739,271

[22] Filed: Aug. 1, 1991

[30] Foreign Application Priority Data

Aug. 7, 1990 [JP] Japan ..... 2-209977

[51] Int. Cl.[5] ..... H01P 1/205

[52] U.S. Cl. ..... 333/206; 333/202

[58] Field of Search ..... 333/202, 206, 207, 222, 333/223

[56] References Cited

U.S. PATENT DOCUMENTS 4,987,393 1/1991 Yorita et al. ..... 333/207 X

FOREIGN PATENT DOCUMENTS 0312011 4/1989 European Pat. Off. ..... 333/202
0191101 8/1986 Japan ..... 333/206
0237501 10/1986 Japan ..... 333/202
0117401 5/1987 Japan ..... 333/206
0224502 9/1988 Japan ..... 333/202
0069102 3/1989 Japan ..... 333/202

*Primary Examiner*—Robert J. Pascal
*Assistant Examiner*—Seung Ham
*Attorney, Agent, or Firm*—Lowe, Price, LeBlanc & Becker

[57] ABSTRACT

A dielectric filter including a plurality of coaxial type dielectric resonators having outer conductors and inner conductors is arranged so that the outer conductors are connected to each other. Also included in the dielectric filter are central conductors arranged to be brought into contact with the inner conductors of said plurality of coaxial type dielectric resonators and a dielectric substrate having thereon a plurality of substrate conductors whose number at least corresponds to the number of the plurality of coaxial type dielectric resonators, and input-/output terminals provided on said dielectric substrate. The central conductors are respectively coupled to the substrate conductors provided on the dielectric substrate and inductance elements are connected to the substrate conductors which are positioned at both sides.

10 Claims, 6 Drawing Sheets

DIELECTRIC FILTER HAVING INDUCTIVE INPUT/OUTPUT COUPLING

BACKGROUND OF THE INVENTION

The present invention relates to a dielectric filter to be used in a high-frequency range.

Dielectric filters generally compose a plurality of resonators, the interstage coupling being made using coils (for example, air-core coils). This provision of the coils requires an installation space whereby difficulty is encountered to achieve the size-reduction, particularly reduction of the dimension of the dielectric filter in the height directions. In addition, since the coil are required to be mounted on a substrate, the provision thereof results in being troublesome. Still further, since the inductances of the coils considerably scatters, the inductance adjustments for the coils are required after assembling. One possible solution is to pattern the coils on a substrate. However, one problem faced in patterning the coils is to greatly increase insertion loss of the filter because the Q factor of the patterned coil is limited to about 10 (900 MHz).

Prior to describing an embodiment of the present invention, a brief description of conventional dielectric filers will be described hereinbelow for a better understanding of the present invention. FIGS. 1A and 1B are illustrations of a conventional dielectric filter, FIG. 1A being a perspective view showing the conventional dielectric filter and FIG. 1B being a cross-sectional view taken along a line B—B. In FIGS. 1A and 1B, the conventional dielectric filter is composed of quarter-wave coaxial type resonators 101 to 104 each of which may be made such that $BaTi_4O_9$ based ceramic powder is produced and then baked so as to form conductive layers at the inside and outside thereof before removing the conductive layers presented at the upper portion of an outer conductor. Each of the conductive layers is formed by means of the printing of an Ag paste or the like. It is also appropriate to form the conductive layer by means of the Cu plating. Illustrated at numeral 105 is a dielectric substrate which is an $Al_2O_3$ ceramic substrate, $Ba_2Ti_9O_{20}$ based ceramic substrate, $BaO—TiO_2—Sm_2O_3$ based ceramic substrate or the like. The dielectric substrate 105 has an arrangement as illustrated in FIGS. 1C to 1E. FIG. 1C is a top surface illustration of the dielectric substrate 105, FIG. 1D is a side illustration thereof and FIG. 1E is a bottom surface illustration thereof. In FIGS. 1C to 1E, on the front surface of the dielectric substrate 105 there are provided conductors 107, 108, 118 and 120, and on the bottom surface thereof there are provided conductors 116, 117, 128 and 129. Here, numerals 113, 114 and 115 respectively represent air-core coils. Further, In FIGS. 1A and 1B, numerals 121 and 122 respectively designate input and output terminals, 123 depicts a housing and 124 to 127 are respectively central conductors. In the dielectric filter thus arranged, capacitances are formed between the conductors 118 and 128 and further between the conductors 120 and 129 and the interstage couplings are made through the air-core coils 113 to 115. Further, for polarizing, in ranges between the input and output terminals 121, 122 and the interstage resonators 102, 103 contacting with the input/output side resonators 101, 104, capacitances are constituted between the conductors 107 and 116 constructed on the dielectric substrate 105 and further between the conductors 108 and 117 similarly constructed thereon, thereby forming a plurality of poles as illustrated in FIG. 1G. FIG. 1F shows an equivalent circuit of the conventional dielectric filter. As described above, the conventional dielectric filter has disadvantages in that difficulty is encountered to achieve the size-reduction and further to allow the mass production.

SUMMARY OF THE INVENTION

It is therefore an object of the present invention to a dielectric filter with a polarized structure which allows easy mass production and size-reduction.

According to the present invention, a dielectric filter is equipped with coaxial type dielectric resonators each of which is composed of an outer conductor and an inner conductor and one ends of which are open circuited and the other ends of which are shorted. The interstage coupling circuits between said resonators being made with capacitive coupling, the input/output coupling circuits are made with dielectric coupling, and the coupling between input/output terminals of the filter and the interstage resonators contacting with the input/output side resonators are made with capacitive coupling. Preferably, the dielectric coupling and the capacitive coupling are effected by inductance lines formed on a dielectric substrate and capacities between conductors formed on the dielectric substrate.

In accordance with the present invention, there is further provided a dielectric filter comprising a plurality of coaxial type dielectric resonators having outer conductors and inner conductors which outer conductors are connected to each other. Also included in the dielectric filter are central conductors arranged to be brought into contact with the inner conductors of the plurality of coaxial type dielectric resonators, a dielectric substrate having thereon a plurality of substrate conductors whose number at least corresponds to the number of said plurality of coaxial type dielectric resonators, and input/output terminals provided on the dielectric substrate. The central conductors are respectively coupled to the substrate conductors provided on the dielectric substrate, and inductance elements are connected to the conductors of the substrate conductors which are positioned at both sides. preferably, the inductance elements are pattern-formed formed as inductance lines on the dielectric substrate, and the plurality of substrate conductors are formed on a surface of the dielectric surface.

BRIEF DESCRIPTION OF THE DRAWINGS

The object and features of the present invention will become more apparent from the following detailed description with the accompanying drawings in which.

DETAILED DESCRIPTION OF THE INVENTION

Figure 1A:
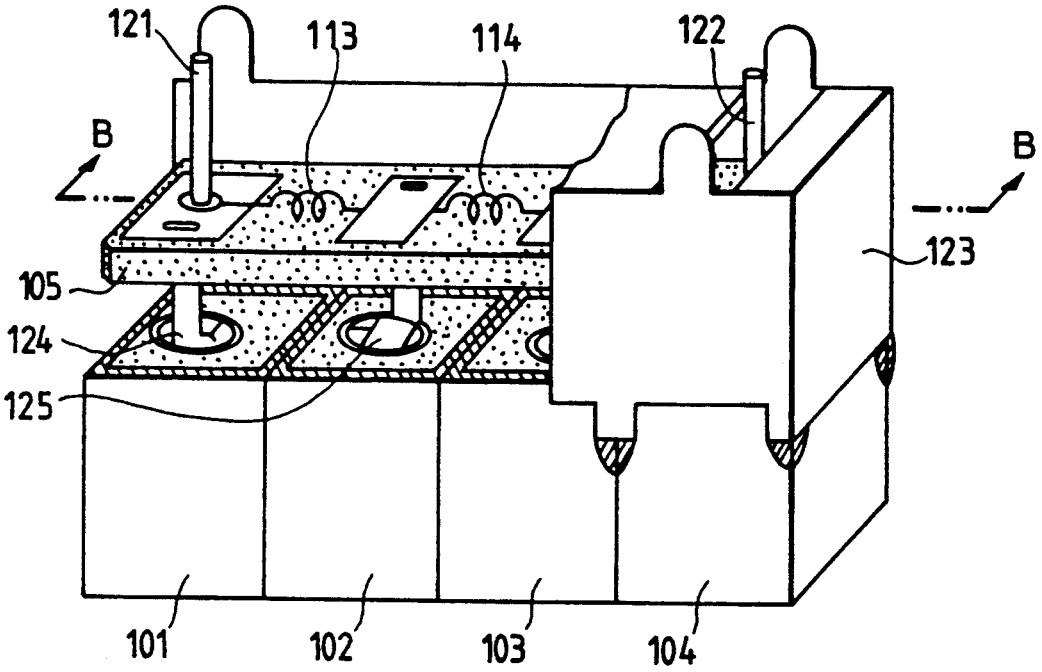
FIG. 1A PRIOR ART
FIG. 1A is a plurality-broken perspective view showing an arrangement of a conventional dielectric filter.
Figure 1B:
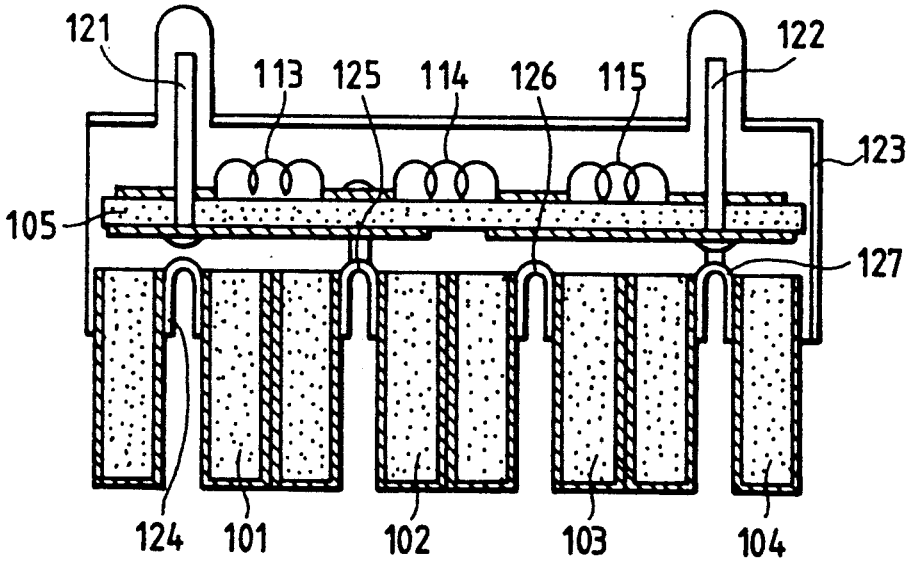
FIG. 1B PRIOR ART
FIG. 1B is a cross-sectional view of the FIG. 1A conventional dielectric filter taken along a line B—B.
Figure 1C:
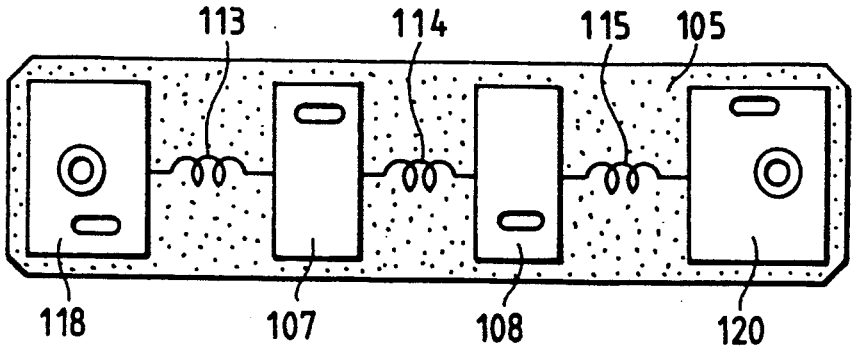
FIG. 1C PRIOR ART
FIGS. 1C to 1E are illustrations for describing an arrangement of a dielectric substrate to be used in the FIG. 1A conventional dielectric filter.
Figure 1D:
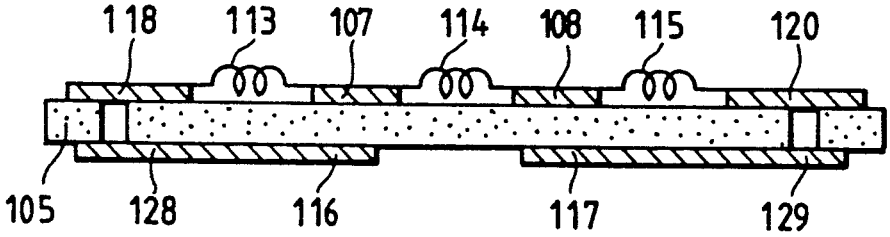
FIG. 1D PRIOR ART
Figure 1E:
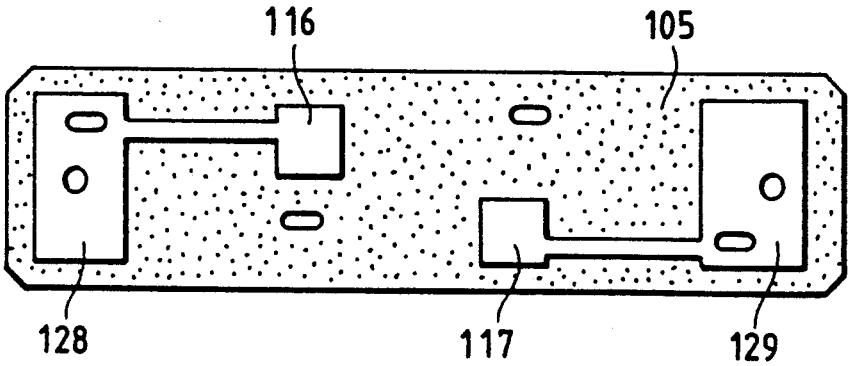
FIG. 1E PRIOR ART
Figure 1F:
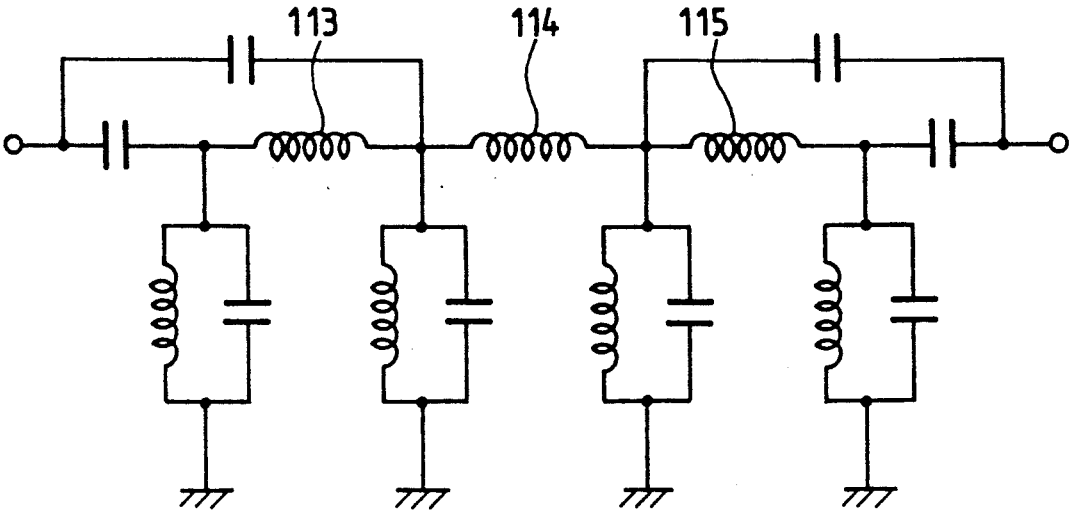
FIG. 1F PRIOR ART
FIG. 1F shows an equivalent circuit corresponding to the FIG. 1A conventional dielectric filter.
Figure 1G:
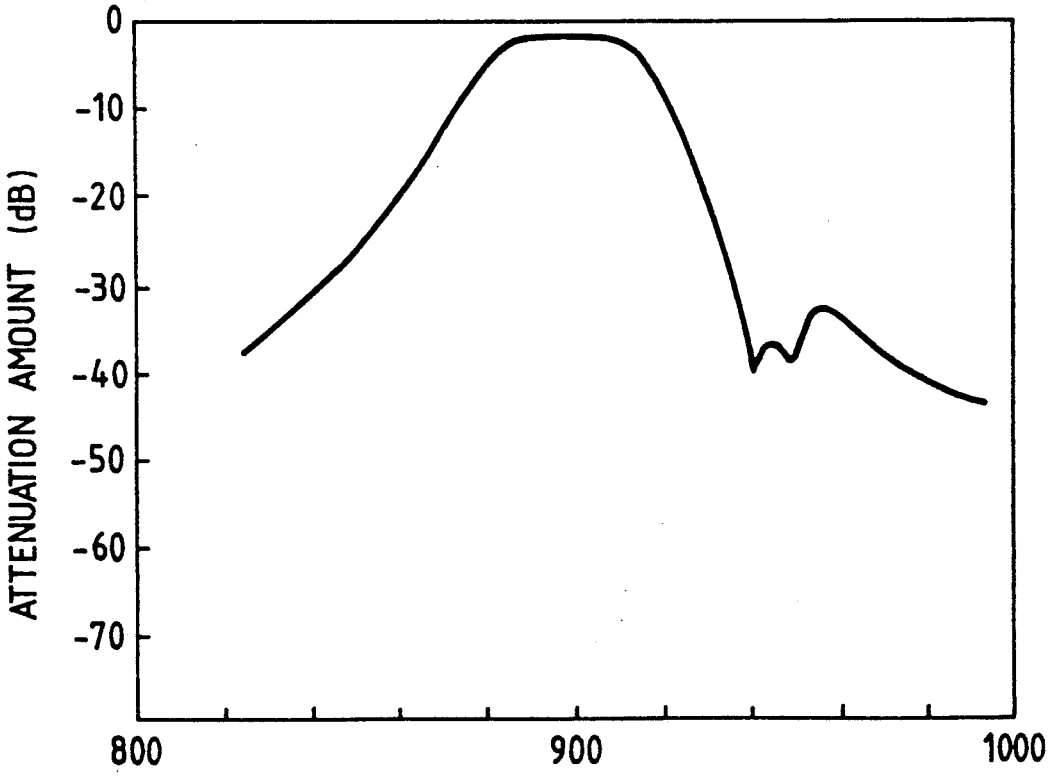
FIG. 1G PRIOR ART
FIG. 1G is an illustration for describing the characteristic of the FIG. 1A conventional dielectric filter.
Figure 2A:
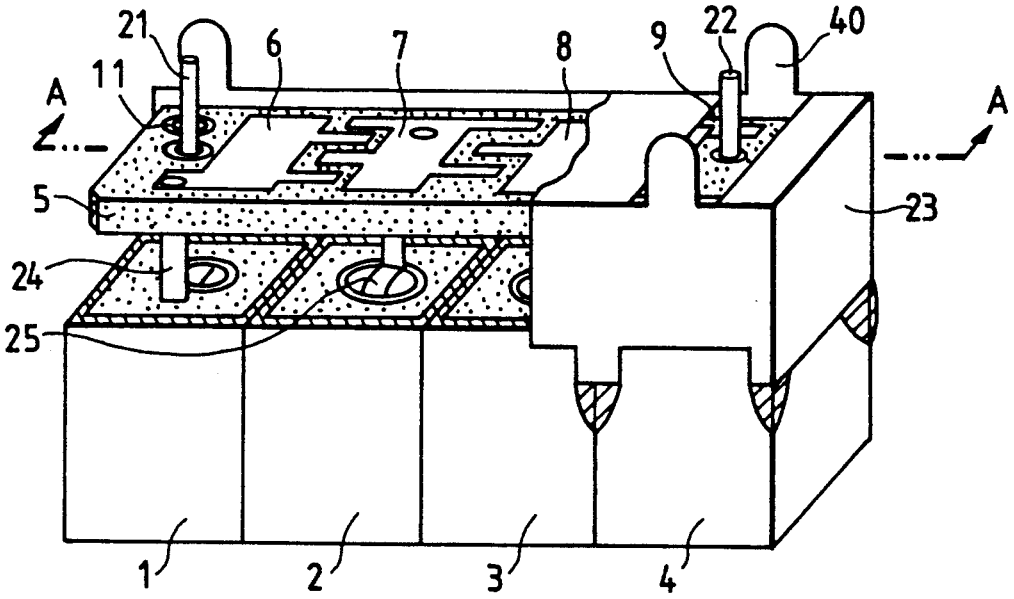
FIG. 2A is a plurality-broken perspective view showing an arrangement of a dielectric filter according to an embodiment of the present invention.
Figure 2B:
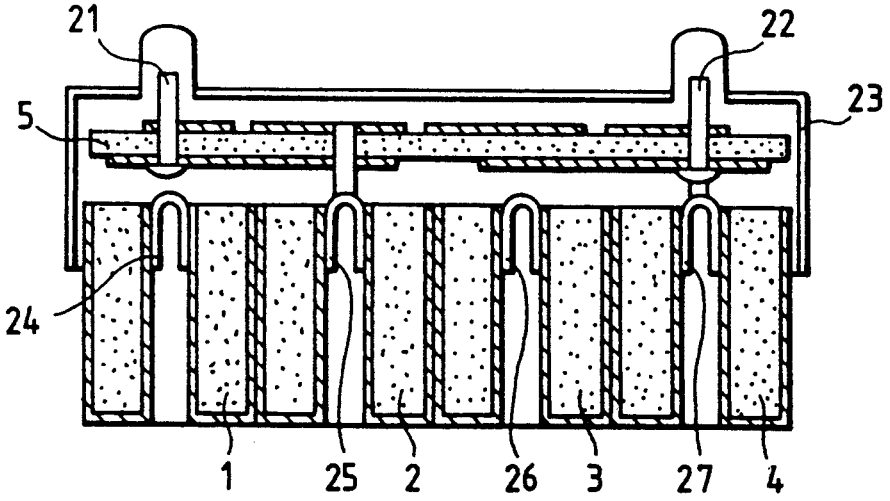
FIG. 2B is a cross-sectional view showing the dielectric filter of this embodiment.
Figure 2C:
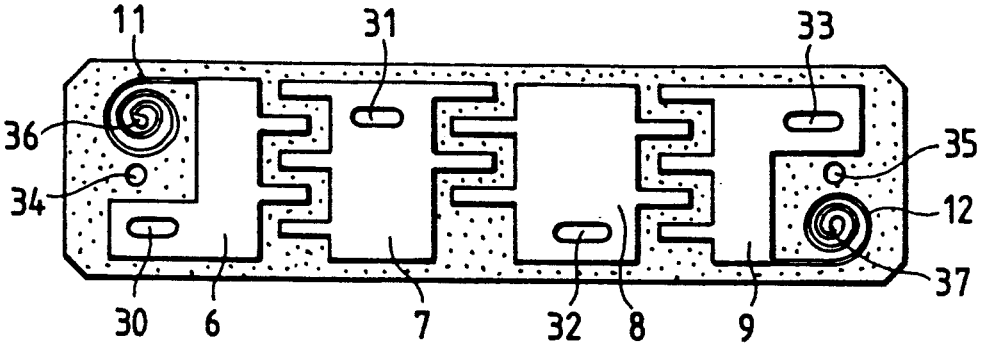
FIGS. 2C to 2E are illustrations of a dielectric substrate to be used in the FIG. 2A dielectric filter.
Figure 2D:
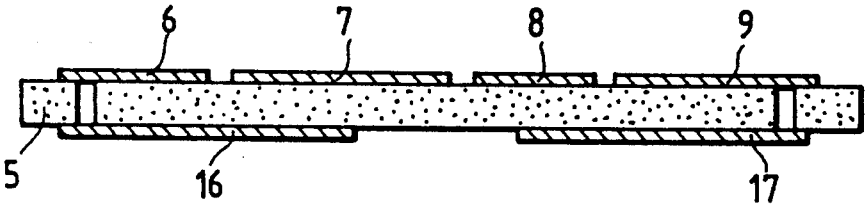
Figure 2E:
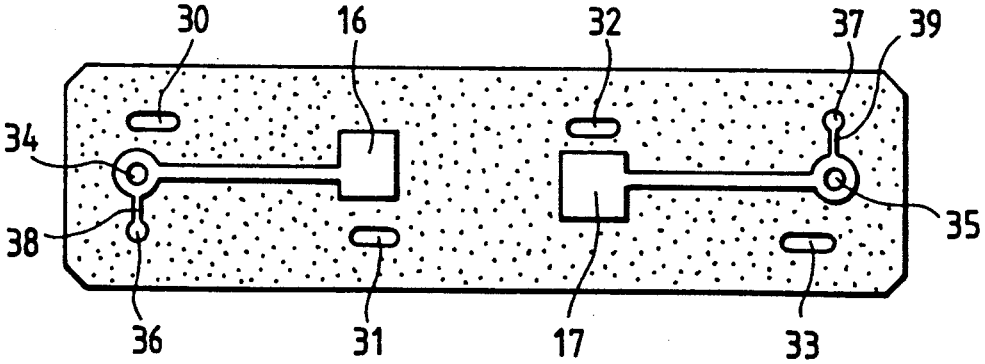
Figure 2F:
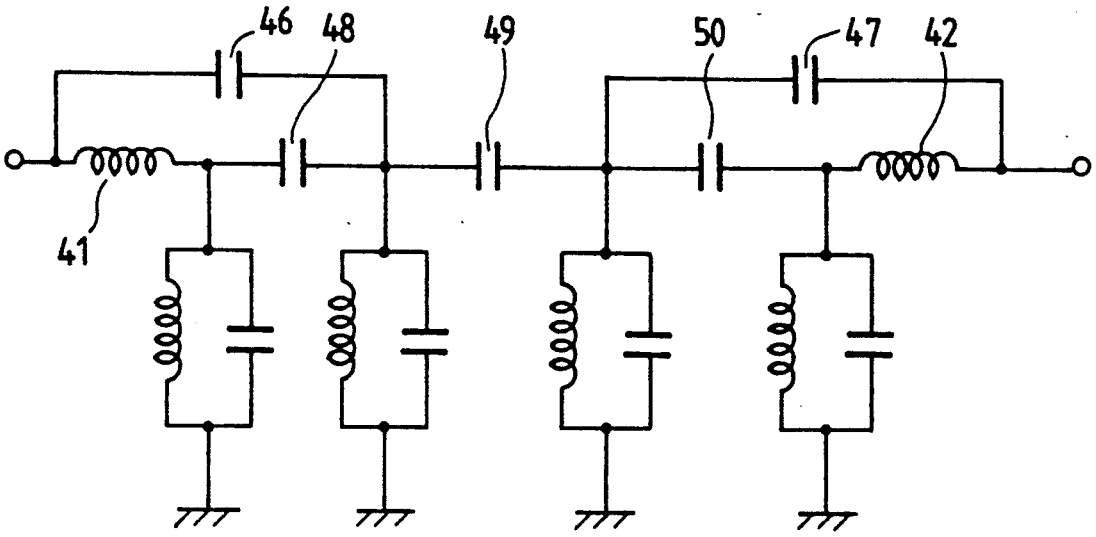
FIG. 2F shown an equivalent circuit corresponding to the FIG. 2A dielectric filter; and FIG. is an illustration for describing the characteristic of the dielectric filter according to this embodiment.

Referring now to FIGS. 2A and 2B there is illustrated an arrangement of a dielectric filter according to an embodiment of the present inventions. FIG. 2A is a perspective view showing the arrangement of the dielectric filter of this invention and FIG., 2B is a cross-sectional view taken along a line A—A. FIG. 2F shows an equivalent circuit of the dielectric filter of this embodiment. As illustrated in FIG. 2F, the dielectric filter of this invention comprises inductive input/output coupling circuits 41, 42 of an input/output circuit, capacitive coupling portions 48, 49, 50, of an interstage coupling circuit and capacitive coupling portions 46, 47 to input and output terminals. In FIGS. 2A and 2B, illustrated at numeral 1 to 4 are quarter-wave coaxial type dielectric resonators which are constructed by using $BaTi_4O_9$ based ceramic, that is, which are constructed such that $BaTi_4O_9$ power is produced and then baked so as to form conductive layers at the inside and outside before removing the conductive layer presented on the upper surface of the outer conductive. The conductive layers can be formed by means of the printing of Ag paste or the like. It is also appropriate to form the conductive layers through the Cu plating. Illustrated at numeral 5 is a dielectric substrate which is arranged as illustrated in FIGS. 2C to 2E, FIG. 2C being a top surface view, FIG. 2D being a side view and FIG. 2E being a bottom surface view. The dielectric substrate 5 is constructed such that surfaces of an $Al_2O_3$ ceramic substrate with a thickness of 0.6 mm (for example) are Ag-metalized so as to realize the inductive coupling portions 41 and 42 of an input/output circuit by means of inductance lines 11 and 12 which are arranged to have spiral configurations and which are connected to the conductors 6 and 9, which are positioned at both sides, and electrically coupled via through-holes 36 and 37 to conductors 38 and 39 and further communicated with input and output terminal holes 34 and 35. Further, the capacitive coupling portions 48, 49 and 50 of the interstage coupling circuit are respectively realized by means of conductors 6, 7, 8 and 9, i.e., gap capacitances between the conductors 6 and 7, between the conductors 7 and 8 and between the conductors 8 and 9. Still further, the capacitive coupling portions 46 and 47 for coupling between input and output terminals 21 and 22 and interstage resonators 2 and 3 contacting with input and output side resonators 1 and 4 are realized by means of the conductors 7, 8 and conductors 16, 17, i.e., the capacitances between the conductors 7 and 16 and between the conductors 8 and 17.

Here, it is also appropriate to use as the dielectric substrate a $Ba_2Ti_9O_{20}$ based ceramic substrate, $BaO—TiO_2—Sm_2O_3$ based ceramic substrate or the like which is made of a material having a high permittivity. Further, in place of the use of the ceramic substrate, it is appropriate that a double-side copper coating printed-substrate is etched so as to form inductance lines 11, 12 and conductor portions and, if required, capacitors are mounted in the case of low capacity values at the capacitive coupling portions.

For electrical and mechanical connections between the dielectric substrate 5 and the inner conductive portions of the respective resonators 1 to 4, central conductors 24 to 27 formed by matching phosphor bronze plates with thicknesses of 0.2 mm to have an adequate configuration are inserted into the inner conductive one end portions of the central conductors are connected by means of the soldering technique and the other end portions are inserted into central conductor holes 30 to 33 and coupled by the soldering technique. It is also appropriate that the connections between the dielectric substrate 5 and the inner conductive portions of the resonators 1 to 4 are made by insertion of the central conductors 24 to 27 under pressure.

The input and output terminals 21 and 22 are made of a metal and inserted into input and output terminal holes 34 of the dielectric substrate 5 and 35 to be fixed by means of the soldering technique. In FIGS. 2A and 2B, numeral 23 represents a case made of a metal and connected to the respective resonators 1 to 4 through the soldering.

Figure 2G:
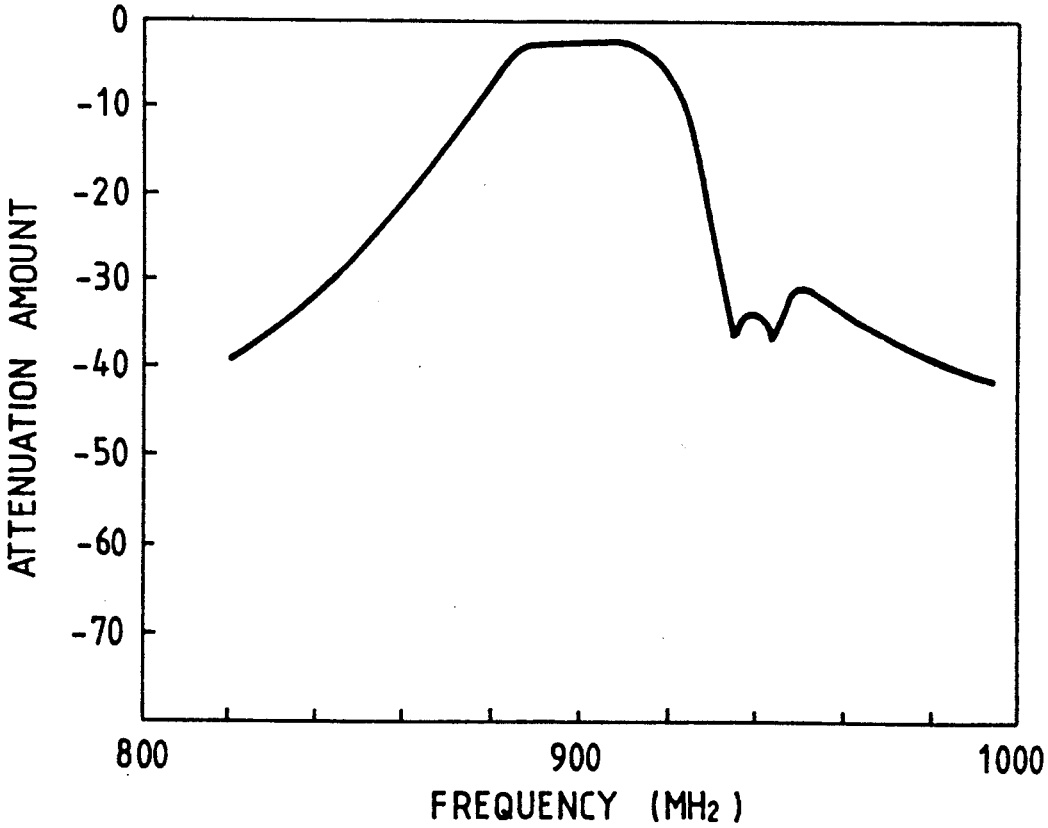

As described above, according to this embodiment, the input and output coupling circuit (the coupling circuit between the input and output terminals 21, 22 and the resonators 1, 4) is constructed by patterning the inductance lines 11, 12 on the dielectric substrate 5 to make the dielectric coupling and the interstage coupling circuits (the coupling circuits between the resonators 1, 2, between the resonators 2, 3, and between the resonators 3, 4) are constructed with gap capacitances between the conductors formed on the dielectric substrate 5 so as to form the capacitive coupling and further the input and output terminals 21, 22 and the interstage resonators 2, 3 contacting with the input/output side resonators 1, 4 are capacitive-coupled with the capacitances between the conductors formed on the dielectric substrate. The coupling capacitances (46) between the input/output terminal 21 and the interstage resonator 2 is arranged to be substantially twice the coupling capacitances (47) between the output terminal 22 and the interstage resonator 3, thereby forming a plurality of poles in the high-frequency attenuation region as illustrated in FIG. 2G. Here, the filter insertion loss when the coils are used for the input/output coupling circuit is substantially the same as the filter insertion loss when the inductance lines 11, 12 are patterned on the dielectric substrate. The following table shows the filter insertion losses of the present embodiment as compared with the conventional dielectric filter when both the coils are used for the dielectric coupling circuit and the inductance lines are also used therefor. Both the filter arrangement (stage number) are arranged to be the same.

| Sample | Invention Filter | | Conventional Filter | |
|---|---|---|---|---|
| No | Inductance | Coil | Inductance | Coil |
| 1 | 2.00 | 2.01 | 3.45 | 2.02 |
| 2 | 1.98 | 1.99 | 3.46 | 2.01 |
| 3 | 2.01 | 2.01 | 3.48 | 2.02 |

According to the present invention, unlike the conventional polarized dielectric filter using coils (air-core coils) in the interstage circuit, the input/output coupling circuit is arranged with inductance lines formed on one piece of dielectric substrate and the interstage coupling circuit is arranged with the capacitances between the conductors formed on the dielectric substrate and the input/output terminals and the interstage resonators contacting with the input/output side resonators are coupled with the capacitances between the conductors formed on the dielectric substrate. This arrangement can result in a plurality of poles formed in the high-frequency attenuation region of the filter without increasing the insertion loss into the band of the filter. In addition, it is possible to achieve the size-reduction and simplification of the arrangement to reduce the cost and further to reduce the characteristic scattering to allow an easy mass production.

It should be understood that the foregoing relates to only embodiments of the present invention, and that it is intended to cover all changes and modifications of the embodiments of this invention herein used for the purposes of the disclosure, which do not constitute departures from the spirit and scope of the invention.

What is claimed is:

1. A dielectric filter comprising coaxial type dielectric resonators each of which is composed of an outer conductor and an inner conductor, one end of both being open-circuited and the other end of both being shorted, interstage coupling circuits between said resonators being made by capacitive coupling, input/output coupling between respective input/output terminals and corresponding input/output side resonators being made with inductive coupling circuits, and coupling between said input/output terminals of said dielectric filter and interstage resonators arranged between and in contact with said input/output side resonators being made with by capacitive coupling.

2. A dielectric filter as claimed in claim 1, wherein the inductive coupling are effected by inductance lines formed on a dielectric substrate, and all the capacitive couplings are effected by capacitances between conductors formed on said dielectric substrate.

3. A dielectric filter as claimed in claim 1, wherein the number of said dielectric resonators is three or more said dielectric resonators being successively arranged.

4. A dielectric filter comprising a plurality of coaxial type dielectric resonators having outer conductors and inner conductors which outer conductors are connected to each other, central conductors arranged to be brought into contact with said inner conductors of said plurality of coaxial type dielectric resonators, a dielectric substrate having thereon a plurality of substrate conductors whose number corresponds to at least the number of said plurality of coaxial type dielectric resonators, and input/output terminals provided on said dielectric substrate and connected to interstage capacitive coupling means for coupling dielectric resonators to said input/output terminals, said central conductors being respectively coupled to said substrate conductors provided on said dielectric substrate, and inductance elements connected between the substrate conductors and respective said input/output terminals, said inductance elements being positioned at both ends in said substrate.

5. A dielectric filter as claimed in claim 4, wherein said inductance elements are pattern-formed as inductance lines on said dielectric substrate.

6. A dielectric filter as claimed in claim 4, wherein said plurality of substrate conductors are formed on a surface of said dielectric substrate.

7. A dielectric filter comprising:

a plurality of coaxial type dielectric resonators having outer conductors and inner conductors which outer conductors are connected to each other;

central conductors each being arranged to be brought into contact with each of said inner conductors of said coaxial type dielectric resonators;

dielectric substrate means for mounting first conductor means, said first conductor means including a plurality of substrate conductors connected to said central conductors;

input/output terminals attached to end portions of said dielectric substrate means;

inductance means provided between substrate conductors positioned at both ends of said substrate and said input/output terminals; and second conductor means connected to said input/output terminals, said second conductor means effecting an interstage capacitance coupling to substrate conductors other than the both end-positioned substrate conductors.

8. A dielectric filter as claimed in claim 7, wherein said first conductor means is formed on one surface of said dielectric substrate and said second conductor means is formed on the other surface of said dielectric substrate.

9. A dielectric filter as claimed in claim 7, wherein said inductance means is pattern-formed as inductance lines on said dielectric substrate.

10. A dielectric filter as claimed in claim 9, wherein each of said inductance lines has a spiral configuration.

* * * * *